US008124008B2

(12) United States Patent
Murakami et al.

(10) Patent No.: US 8,124,008 B2
(45) Date of Patent: Feb. 28, 2012

(54) FREE CUTTING STEEL

(75) Inventors: Toshiyuki Murakami, Tokyo (JP); Tetsuo Shiraga, Tokyo (JP); Kiyohito Ishida, Sendai (JP); Katsunari Oikawa, Shibata-machi (JP)

(73) Assignees: JFE Bars & Shapes Corporation, Tokyo (JP); National Institute of Advanced Industrial Science & Technology, Tokyo (JP); Kiyohito Ishida, Sendai-shi, Miyagi (JP)

( * ) Notice: Subject to any disclaimer, the term of this patent is extended or adjusted under 35 U.S.C. 154(b) by 1733 days.

(21) Appl. No.: 10/495,902

(22) PCT Filed: Nov. 29, 2002

(86) PCT No.: PCT/JP02/12559

§ 371 (c)(1),
(2), (4) Date: Oct. 12, 2004

(87) PCT Pub. No.: WO03/046240

PCT Pub. Date: Jun. 5, 2003

(65) Prior Publication Data

US 2004/0258555 A1 Dec. 23, 2004

(30) Foreign Application Priority Data

Nov. 30, 2001 (JP) ..... 2001-366695
Jun. 26, 2002 (JP) ..... 2002-185494
Jun. 26, 2002 (JP) ..... 2002-185495
Jun. 26, 2002 (JP) ..... 2002-185496

(51) Int. Cl.
*C22C 38/60* (2006.01)
*C22C 38/18* (2006.01)

(52) U.S. Cl. ..... 420/87; 420/84; 420/104

(58) Field of Classification Search ..... 420/87, 420/84, 104
See application file for complete search history.

(56) References Cited

U.S. PATENT DOCUMENTS 5,639,421 A 6/1997 Ichikawa et al.

FOREIGN PATENT DOCUMENTS

EP 1 069 198 A1 1/2001

(Continued)

OTHER PUBLICATIONS

Bingley W.S. et al., "Behaviour of low and medium carbon free cutting steels during deformation to large strains," *Materials Science and Technology*, vol. 14, No. 9, 1998, pp. 108-122.

(Continued)

*Primary Examiner* — Emily Le
*Assistant Examiner* — Rebecca Lee
(74) *Attorney, Agent, or Firm* — Holtz Holtz Goodman & Chick PC

(57) ABSTRACT

A low carbon free cutting steel can be obtained by allowing the steel to contain 0.02 to 0.15 mass % of C, 0.05 to 1.8 mass % of Mn, 0.20 to 0.49 mass % of S, more than 0.01 mass % and not more than 0.03 mass % of O, 0.3 to 2.3% of Cr, and the balance consisting of Fe and inevitable impurities, the Cr/S ratio falling within a range of between 2 and 6.

4 Claims, 1 Drawing Sheet

FOREIGN PATENT DOCUMENTS

| | | | |
|---|---|---|---|
| JP | 62-270752 | A | 11/1987 |
| JP | 63-137147 | A | 6/1988 |
| JP | 1-32302 | B2 | 6/1989 |
| JP | 1-309946 | A | 12/1989 |
| JP | 2-6824 | B2 | 2/1990 |
| JP | 3-2351 | A | 1/1991 |
| JP | 9-25539 | A | 1/1997 |
| JP | 2000-160284 | A | 6/2000 |
| JP | 2000-319753 | A | 11/2000 |

OTHER PUBLICATIONS

Filippi, P.A. et al., "Automation of sulfide testing of improved-machinability steels," *Symp. Pap.—Int. Symp. Quant. Metallogr.*, Publisher: Assoc. Ital. Metall., Milan, Italy, 1978, pp. 199-208.

International Preliminary Examination Report PCT/IPEA/409 (3 pages) in PCT/JP2002/012559 with a noted "Date of completion" of Feb. 23, 2004.

FREE CUTTING STEEL

This application is a U.S. National Phase Application under 35 USC 371 of International Application PCT/JP02/12559 filed Nov. 29, 2002.

TECHNICAL FIELD

The present invention relates to a free cutting steel, particularly, to a low carbon free cutting steel to which lead is not added or in which the lead addition amount is markedly decreased from the conventional level of 0.15 to 0.35 mass %, which is adapted for use as a substitute steel for the conventional low carbon resulfurized and leaded free cutting steel, to a low carbon resulfurized and leaded free cutting steel superior in machinability to the conventional low carbon resulfurized and leaded steel, and to a resulfurized or resulfurized and leaded free cutting steel having an oxygen concentration lower than that in the prior art, low in the surface flaw, and excellent in machinability.

BACKGROUND ART

A low carbon resulfurized and leaded free cutting steel, in which lead (Pb) and sulfur (S) are added as the free cutting elements to a low carbon steel for imparting a free-cutting capability to the steel, is known as a low carbon free cutting steel. However, there is a requirement for suppressing the use of Pb, which is used as one of the free cutting elements, in view of the earth environmental problem.

Such being the situation, Japanese Patent Disclosure (Kokai) No. 9-25539 (hereinafter referred to as "prior art 1") discloses a free cutting microalloyed steel without quenching and tempering to which Pb is not added. In this case, Nd is added to the steel for promoting the finely dispersed precipitation of MnS. Japanese Patent Disclosure No. 2000-160284 (hereinafter referred to as "prior art 2") also discloses a free cutting steel to which Pb is not added. In this case, a large amount of S is added to the steel so as to increase the amount of the sulfide, and the form of the sulfide is controlled by oxygen. Further, Japanese Patent Publication (Kokoku) No. 2-6824 (hereinafter referred to as "prior art 3") discloses a free cutting steel, in which Cr having a reactivity with S to form a compound higher than that of Mn is added to the steel so as to form CrS in place of MnS, thereby improving the free-cutting capability.

However, prior art 1 is directed to a microalloyed steel containing 0.2 to 0.6% of C without quenching and tempering. In addition, a special element of Nd is used in prior art. It follows that it is impossible to comply sufficiently with the requirement for the cost reduction. Also, a large amount of S is added to the steel in prior art 2, with the result that the hot ductility of the steel tends to be lowered. Further, prior art 3 necessitates the addition of a large amount reaching 3.5 to 5.9% of costly Cr, resulting in failure to comply sufficiently with the requirement for the cost reduction. In addition, formation of a large amount of CrS as in prior art 3 is disadvantageous because the difficulty accompanying the smelting of the material is increased by the presence of a large amount of CrS.

There is a strong requirement for the further improvement in the machinability of the low carbon resulfurized and leaded free cutting steel in view of the reduction in the machining cost.

In compliance with the requirement, Japanese Patent Publication (Kokoku) No. 1-32302 B2 (hereinafter referred to as "prior art 4") discloses a free cutting steel, in which a relatively large amount of S is added to the steel so as to increase the amount of the sulfide, and the form of the sulfide is controlled by Te, and the oxygen amount is suppressed to 0.0030% or less so as to decrease the number of alumina clusters, thereby improving the machinability of the free cutting steel. Also, Japanese Patent Disclosure No. 1-309946 (hereinafter referred to as "prior art 5") discloses a free cutting steel, in which a relatively large amount of S is added to the steel so as to increase the amount of the sulfide, and a free cutting element of Pb is added to the steel so as to improve the machinability of the free cutting steel. Prior art 5 also teaches that the oxygen amount is suppressed to 0.008% or less for preventing the streak flaw caused by the gigantic oxide.

In each of prior arts 4 and 5, however, the form of the sulfide which effective for improving the machinability of the free cutting steel cannot be controlled sufficiently because the oxygen content of the steel is low, with the result that an elongated sulfide comes to be present in the steel. It follows that the free cutting steel is incapable of producing a sufficient effect of improving the machinability of the free cutting steel. Also, as described previously, the free cutting steel of prior art 2 is excellent in machinability because the form of a large amount of the sulfide is controlled by oxygen. However, the hot ductility of the free cutting steel tends to be lowered because a large amount of S is added to the steel.

On the other hand, the resulfurized and resulfurized and leaded free cutting steels contain in general a large amount of oxygen in order to control the form of the sulfide which is effective for improving the machinability of the free cutting steel. However, since all the oxygen does not dissolve in the sulfide, it is unavoidable for a gigantic oxide to be formed so as to cause the streak flaw, thereby giving rise to a serious defect in the processed article.

In prior art 5, the oxygen content of steel is suppressed to 0.008% or less in order to avoid generation of the streak flaw. In prior art 2, the required amount of oxygen is decreased by increasing the addition amount of S. Further, in prior art 1, the required amount of oxygen is decreased by using Nd as a free cutting element.

In prior art 5, however, the oxygen amount is simply decreased, though the oxygen amount is limited to 0.008% or less. Therefore, the form of the sulfide cannot be sufficiently controlled, as desired, with the result that an elongated sulfide comes to be present in the steel. It follows that the free cutting steel disclosed in prior art 5 cannot be said to be satisfactory in terms of the machinability. Also, concerning the free cutting steel disclosed in prior art 2, the reduction in the hot ductility caused by S is worried about as pointed out previously. Further, in prior art 1, as described above, there is a problem that it is difficult to reduce the cost.

DISCLOSURE OF THE INVENTION

A first object of the present invention is to provide a low carbon free cutting steel to which lead is not added or in which the lead addition amount is markedly lowered from the level in the conventional low carbon resulfurized and leaded free cutting steel, the low carbon free cutting steel being allowed to exhibit a machinability fully comparable to or higher than that in the conventional low carbon resulfurized and leaded free cutting steel without obstructing the cost reduction and without lowering the hot ductility.

A second object of the present invention is to provide a low carbon resulfurized and leaded free cutting steel exhibiting a machinability superior to that in the prior art without increasing the lead and sulfur contents from the conventional levels.

Further, a third object of the present invention is to provide a resulfurized or resulfurized and leaded free cutting steel exhibiting a machinability superior to that of the conventional steel in spite of the oxygen content lower than that in the conventional steel containing substantially the same amounts of sulfur and lead without obstructing the cost reduction and without lowering the hot ductility, and having a small surface flaw formed in the rolling step, which is derived from the blow-hole generated in the casting step as a result of achieving a low oxygen content.

According to a first aspect of the present invention, there is provided a low carbon free cutting steel containing 0.02 to 0.15 mass % of C, 0.05 to 1.8 mass % of Mn, 0.20 to 0.49 mass % of S, more than 0.01 mass % and not more than 0.03 mass % of O, 0.3 to 2.3 mass % of Cr, and the balance consisting of Fe and inevitable impurities, the Cr/S ratio falling within a range of between 2 and 6.

According to a second aspect of the present invention, there is provided a low carbon resulfurized and leaded free cutting steel excellent in machinability, containing 0.02 to 0.15 mass % of C, 0.05 to 1.00 mass % of Mn, 0.20 to 0.49 mass % of S, more than 0.008 mass % and not more than 0.030 mass % of O, 0.04 to 0.35 mass % of Pb, 0.3 to 2.3% of Cr, and the balance consisting of Fe and inevitable impurities, the Cr/S ratio falling within a range of between 2 and 6.

According to a third aspect of the present invention, there is provided a resulfurized or resulfurized and leaded free cutting steel small in surface flaw and excellent in machinability, said free cutting steel containing 0.16 to 0.49 mass % of S and 0.002 to 0.010 mass % of O, wherein the sulfide having an aspect ratio not larger than 5 occupies at least 80% of the sulfides having the major axis of at least 10 μm.

Further, according to a fourth aspect of the present invention, there is provided a resulfurized or resulfurized and leaded free cutting steel small in surface flaw and excellent in machinability, containing 0.02 to 0.15 mass % of C, 0.05 to 1.8 mass % of Mn, 0.16 to 0.49 mass % of S, 0.002 to 0.010 mass % of O, 0.3 to 2.3% of Cr, and the balance consisting of Fe and inevitable impurities, the Cr/S ratio falling within a range of between 2 and 6.

BEST MODE FOR WORKING THE INVENTION

Figure 1:
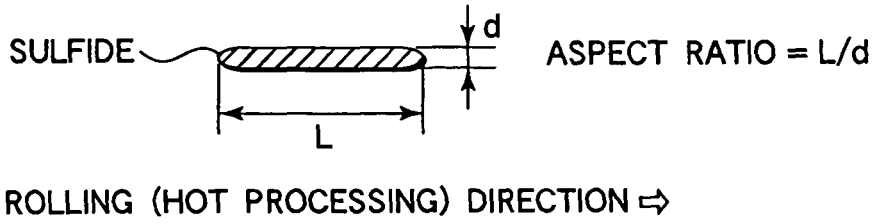
FIG. 1 is a drawing for explaining an aspect ratio.

The present invention will now be described in detail.

1. First Free Cutting Steel:

A first free cutting steel is provided by the low carbon free cutting steel according to the first aspect of the present invention, containing 0.02 to 0.15 mass % of C, 0.05 to 1.8 mass % of Mn, 0.20 to 0.49 mass % of S, more than 0.01 mass % and not more than 0.03 mass % of O, 0.3 to 2.3% of Cr, and the balance consisting of Fe and inevitable impurities, the Cr/S ratio falling within a range of between 2 and 6.

It is possible for the first free cutting steel of the present invention to further contain not more than 0.1 mass % of Si, 0.01 to 0.12 mass % of P, and not more than 0.01 mass % of Al.

It is also possible for the first free cutting steel of the present invention to further contain at least one element selected from the group consisting of 0.0001 to 0.0005 mass % of Ca, 0.01 to 0.03 mass % of Pb, 0.02 to 0.30 mass % of Se, 0.1 to 0.15 mass % of Te, 0.02 to 0.20 mass % of Bi, 0.003 to 0.020 mass % of Sn, 0.004 to 0.010 mass % of B, 0.005 to 0.015 mass % of N, 0.05 to 0.50 mass % of Cu, 0.003 to 0.090 mass % of Ti, 0.005 to 0.200 mass % of V, 0.005 to 0.090 mass % of Zr, and 0.0005 to 0.0080 mass % of Mg.

In the free cutting steel of the composition described above, it is desirable for the sulfide having the major axis of at least 10 μm to occupy at least 90% of all the sulfides. It is also desirable for sulfide having an aspect ratio not larger than 5 to occupy at least 80% of the sulfides having the major axis at least 10 μm. Further, it is desirable for the particular free cutting steel to have a ferrite-pearlite micro structure with a prior austenite grain diameter exceeding the grain size number 7.

As a result of an extensive research conducted in an effort to achieve the first object described above, the present inventors have found that:

(i) It is possible to obtain a suitable amount of a sulfide containing both Cr and Mn by the addition of suitable amounts of Cr, Mn and S and by optimizing the Cr/S ratio. Since the sulfide containing both Cr and Mn suppresses the elongation in the hot working step, it is possible to allow the sulfide to be large and to be formed like a spindle.

(ii) In view of the idea known to the art that, where the S amount is the same, the machinability of the free cutting steel is improved with increase in the size of the sulfide and with change in the form of the sulfide toward the spindle shape, it is considered reasonable to understand that a large and spindle-shaped sulfide is formed by the addition of suitable amounts of Cr, Mn and S and by the optimization of the Cr/S ratio, thereby improving the machinability of the free cutting steel including the chip disposability and the surface roughness.

(iii) It is known to the art that the machinability is improved with increase in the S amount. However, there is an upper limit in the S amount because of the problem in terms of the anisotropy in the hot workability or the mechanical properties. On the other hand, if a large and spindle-shaped sulfide is formed by the addition of suitable amounts of Cr, Mn and S and by the optimization of the Cr/S ration as described above, it is possible to elevate the upper limit of the S amount. As a result, the machinability of the free cutting steel including the chip disposability and the surface roughness can be markedly improved, even if Pb is not added or even if the Pb amount is markedly lowered from the level in the prior art.

It is possible for the first free cutting steel described above, which has been obtained on the basis of the ideas given above, to exhibit a machinability fully comparable to or higher than that exhibited by the conventional low carbon resulfurized and leaded free cutting steel without obstruction the cost reduction and without lowering the hot ductility, even if lead is not added to the free cutting steel or even if the lead addition amount is markedly lowered from the level in the conventional low carbon resulfurized and leaded free cutting steel.

The reasons for defining the composition of the first free cutting steel as described above will now be described.

(a) C: 0.02 to 0.15 Mass %

Carbon, which seriously affects the strength and the machinability of the steel, is an important element. However, if the C content is lower than 0.02 mass %, it is impossible to obtain a sufficient strength of the steel. On the other hand, if the C content exceeds 0.15 mass %, the strength of the steel is rendered excessively high so as to deteriorate the machinability of the steel. Such being the situation, the C content is defined in the present invention to fall within a range of between 0.02 mass % and 0.15 mass %. Preferably, the C content should fall within a range of between 0.02 mass % and 0.10 mass %.

(b) Mn: 0.05 to 1.8 Mass %

Manganese is a sulfide formation element that is important for improving the machinability of the steel. However, if the Mn content is lower than 0.05 mass %, the amount of the sulfide formed is excessively small, resulting in failure to obtain a sufficient machinability. On the other hand, if the Mn content exceeds 1.8 mass %, the formed sulfide is much elongated, with the result that the machinability of steel is lowered. Such being the situation, the Mn content is defined in the present invention to fall within a range of between 0.05 and 1.8 mass %. Preferably, the Mn content should be not lower than 0.22 mass % and lower than 0.60 mass %.

(c) S: 0.20 to 0.49 Mass %

Sulfur is a sulfide formation element which forms a sulfide effective for improving the machinability of the steel. However, if the S content is lower than 0.20 mass %, the amount of the sulfide formed is excessively small, resulting in failure to obtain a sufficient effect for improving the machinability of the steel. On the other hand, if the S content exceeds 0.49 mass %, the hot workability and the ductility of the steel are markedly lowered. Such being the situation, the S content of steel is defined in the present invention to fall within a range of between 0.20 and 0.49 mass %.

(d) O: Higher than 0.01 Mass and not Higher than 0.03 Mass %

Oxygen is an element effective for suppressing the elongation of the sulfide in the hot working step such as a rolling step. Therefore, oxygen is an element important for improving the machinability of the steel by suppressing the elongation of the sulfide. However, if the O content is not higher than 0.01 mass %, it is difficult to obtain a sufficient effect of suppressing the elongation of the sulfide. Since the elongated sulfide remains in the steel, it is impossible to obtain a sufficient effect of improving the machinability of the steel. On the other hand, even if the O addition amount exceeds 0.03 mass %, the effect of suppressing the elongation of the sulfide is saturated. It follows that the addition of an excessively large amount of O is disadvantageous in economy. In addition, a casting defect such a blow-hole is generated. Under the circumstances, the O content is defined in the present invention to exceed 0.01 mass % and to be not higher than 0.03 mass %.

(e) Cr: 0.3 to 2.3 Mass %

Chromium is an element effective for suppressing the elongation of the sulfide in the hot working step such as a rolling step. Therefore, Cr is an element important for improving the machinability of the steel by suppressing the elongation of the sulfide. However, if the Cr content is lower than 0.3 mass %, it is difficult to obtain a sufficient effect of suppressing the elongation of the sulfide. Since the elongated sulfide remains in the steel, it is impossible to obtain a sufficient effect of improving the machinability of the steel. On the other hand, even if the Cr addition amount exceeds 2.3 mass %, the effect of suppressing the elongation of the sulfide is saturated. It follows that the addition of an excessively large amount of Cr is disadvantageous in economy. Under the circumstances, the Cr content is defined in the present invention to fall within a range of between 0.3 mass % and 2.3 mass %. Preferably, the Cr content should fall within a range of between 0.3 mass % and 1.5 mass %.

(f) Cr/S Ratio: 2 to 6

The Cr/S ratio is an important index seriously affecting the degree of elongation of the sulfide in the hot working step such as a rolling step. It is possible to obtain a sulfide having a desired degree of elongation, which permits improving the machinability of the steel, by defining the Cr/S ratio appropriately. If the Cr/S ratio is smaller than 2, the sulfide elongated by the formation of MnS is rendered prominent so as to deteriorate the machinability of the steel. On the other hand, if the Cr/S ratio exceeds 6, the effect of suppressing the elongation of the sulfide is saturated. Such being the situation, the Cr/S ratio is defined in the present invention to fall within a range of between 2 and 6. Preferably, the Cr/S ratio should fall within a range of between 2 and 4.

The conditions given above are absolutely necessary for the first free cutting steel of the present invention. The other conditions of the first free cutting steel are as follows:

(g) Si: 0.1 Mass % or Less

Silicon is a deoxidizing element. Since the oxide of Si acts as a nucleus of the sulfide formation, Si promotes the sulfide formation so as to pulverize finely the sulfide, with the result that the tool life is shortened. Such being the situation, where it is desired to further prolong the tool life, it is desirable to define the Si content not to exceed 0.1 mass %. More desirably, the Si content of the steel should not exceed 0.03 mass %.

(h) P: 0.01 to 0.12 Mass %

Phosphorus is an element effective for suppressing the formation of the built-up edge in the cutting process step so as to lower the finish surface roughness. However, if the P content is lower than 0.01 mass %, it is difficult to obtain a sufficient effect. On the other hand, if the P content exceeds 0.12 mass %, the effect noted above is saturated. Also, the hot workability and the ductility of the steel are markedly lowered. Such being the situation, the P content is defined in the present invention to fall within a range of between 0.01 mass % and 0.12 mass %. Preferably, the P content should fall within a range of between 0.01 mass % and 0.09 mass %.

(i) Al: 0.01 Mass % or Less

Aluminum is a deoxidizing element like Si. Since the oxide of Al acts as a nucleus of the sulfide formation, Al promotes the sulfide formation so as to pulverize finely the sulfide, with the result that the tool life is shortened. Such being the situation, where it is desired to further prolong the tool life, it is desirable to define the Al content not to exceed 0.01 mass %. More desirably, the Al content of the steel should not exceed 0.003 mass %.

(j) At Least One of:

Ca: 0.0001 to 0.0005 mass %;
Pb: 0.01 to 0.03 mass %;
Se: 0.02 to 0.30 mass %;
Te: 0.1 to 0.15 mass %;
Bi: 0.02 to 0.20 mass %;
Sn: 0.003 to 0.020 mass %;
B: 0.004 to 0.010 mass %;
N: 0.005 to 0.015 mass %;
Cu: 0.05 to 0.50 mass %;
Ti: 0.003 to 0.090 mass %;
V: 0.005 to 0.200 mass %;
Zr: 0.005 to 0.090 mass %;
Mg: 0.0005 to 0.0080 mass %.

Any of Ca, Pb, Se, Te, Bi, Sn, B, N, Cu, Ti, V, Zr and Mg is used in the case where it is important to improve the machinability of the steel. However, if the addition amount of each of these elements is smaller than the lower limit noted above, the effect of improving the machinability of the steel cannot be obtained. On the other hand, where the addition amount of each of these elements exceeds the upper limit noted above, the effect of improving the machinability of the steel is saturated. Also, the addition of an excessively large amount of each of these elements is disadvantageous in economy. Under the circumstances, in the case of adding these elements, these elements should be added such that Ca falls within a range of between 0.0001 and 0.0005 mass %, Pb falls within a range of between 0.01 and 0.03 mass %, Se falls within a range of between 0.02 and 0.30 mass %, Te falls within a range of between 0.1 and 0.15 mass %, Bi falls within a range of between 0.02 and 0.20 mass %, Sn falls within a range of between 0.003 and 0.020 mass %, B falls within a range of between 0.004 and 0.010 mass %, N falls within a range of between 0.005 and 0.015 mass %, Cu falls within a range of between 0.05 and 0.50 mass %, Ti falls within a range of between 0.003 and 0.090 mass %, V falls within a range of between 0.005 and 0.200 mass %, Zr falls within a range of between 0.005 and 0.090 mass %, and Mg falls within a range of between 0.0005 and 0.0080 mass %.

(k) Micro Structure

It is desirable for the micro structure of the first free cutting steel to be a ferrite • pearlite-based structure. Concerning the machinability of the steel, it is advantageous for the prior austenite grain size to be large. However, a satisfactory machinability can be maintained even in the case of fine grains. In view of the mechanical properties of the article, it is desirable for the grains to be fine such that the grain size exceeds the grain size number 7 (grain size measured by the method of measuring austenite grain size specified in JIS (Japanese Industrial Standards) G 0551).

(l) Size of Sulfide

Concerning the machinability of the steel, it is advantageous for the sulfide to grow into a large body. To be more specific, it is desirable for the major axis of the sulfide to be at least 10 μm. It is also desirable for the sulfide having the major axis of at least 10 μm to occupy at least 90% of all the sulfides.

(m) Aspect Ratio of Sulfide

The aspect ratio of the sulfide is represented by L/d, where "L" denotes the major axis and "d" denotes the minor axis of the sulfide, as shown in FIG. 1. Concerning the machinability of the steel, it is advantageous for the sulfide to be formed like a spindle. Therefore, it is desirable for the sulfide to have an aspect ratio not larger than 5. It is also desirable for the sulfide having an aspect ratio not larger than 5 to occupy at least 80% of the sulfide having the major axis of at least 10 μm.

2. Second Free Cutting Steel

A second free cutting steel is provided by the low carbon free cutting steel according to the second aspect of the present invention, containing 0.02 to 0.15 mass % of C, 0.05 to 1.00 mass % of Mn, 0.20 to 0.49 mass % of S, more than 0.008 mass % and not more than 0.030 mass % of O, 0.04 to 0.35 mass % of Pb, 0.3 to 2.3% of Cr, and the balance consisting of Fe and inevitable impurities, the Cr/S ratio falling within a range of between 2 and 6.

It is possible for the second free cutting steel of the present invention to further contain not more than 0.1 mass % of Si, 0.01 to 0.12 mass % of P, and not more than 0.01 mass % of Al.

It is also possible for the second free cutting steel of the present invention to further contain at least one element selected from the group consisting of 0.0001 to 0.0005 mass % of Ca, 0.02 to 0.30 mass % of Se, 0.1 to 0.15 mass % of Te, 0.02 to 0.20 mass % of Bi, 0.003 to 0.020 mass % of Sn, 0.004 to 0.010 mass % of B, 0.005 to 0.015 mass % of N, 0.05 to 0.50 mass % of Cu, 0.003 to 0.090 mass % of Ti, 0.005 to 0.200 mass % of V, 0.005 to 0.090 mass % of Zr, and 0.0005 to 0.0080 mass % of Mg.

As a result of an extensive research conducted in an effort to achieve the second object described above, the present inventors have found that:

(i) As described above, it is possible to obtain a suitable amount of a sulfide containing both Cr and Mn by the addition of suitable amounts of Cr, Mn and S and by optimizing the Cr/S ratio. Since the sulfide containing both Cr and Mn suppresses the elongation in the hot working step, it is possible to improve the machinability of the steel including the chip disposability and the surface roughness by allowing the sulfide to be large and to be formed like a spindle.

(ii) If a large and spindle-shaped sulfide is formed by the addition of suitable amounts of Cr, Mn and S and by the optimization of the Cr/S ratio as described above, it is possible to elevate the upper limit of the S amount. As a result, it is possible to improve the machinability of the free cutting steel including the chip disposability and the surface roughness.

(iii) The effects described above are combined with the effect produced by the free cutting element of Pb so as to improve markedly the machinability of the free cutting steel including the chip disposability and the surface roughness.

The second free cutting steel of the present invention, which has been achieved on the basis of the ideas given above, exhibits a machinability superior to that exhibited in the past without increasing the lead amount and the sulfur amount from the levels in the prior art.

The reasons for defining the composition of the second free cutting steel as described above will now be described.

(a) C: 0.02 to 0.15 Mass %

If the C content is lower than 0.02 mass %, it is impossible to obtain a sufficient strength of the steel, as described previously in conjunction with the first free cutting steel. On the other hand, if the C content exceeds 0.15 mass %, the strength of the steel is rendered excessively high so as to deteriorate the machinability of the steel. Such being the situation, the C content is defined in the present invention to fall within a range of between 0.02 mass and 0.15 mass %. Preferably, the C content should fall within a range of between 0.02 mass % and 0.10 mass %.

(b) Mn: 0.25 (b) Mn: 0.05 to 1.00 Mass %

Manganese is an element important for improving the machinability of the steel. However, if the Mn content is lower than 0.05 mass %, the amount of the sulfide formed is excessively small, resulting in failure to obtain a sufficient machinability. On the other hand, if the Mn content exceeds 1.00 mass %, the formed sulfide is much elongated, with the result that the machinability of steel is lowered. Such being the situation, the Mn content is defined in the present invention to fall within a range of between 0.05 and 1.00 mass %. Preferably, the Mn content should be not lower than 0.22 mass % and lower than 0.60 mass %.

(c) S: 0.20 to 0.49 Mass %

If the S content is lower than 0.20 mass %, the amount of the sulfide formed is excessively small, resulting in failure to obtain a sufficient effect for improving the machinability of the steel, as described previously in conjunction with the first free cutting steel of the present invention. On the other hand, if the S content exceeds 0.49 mass %, the hot workability and the ductility of the steel are markedly lowered. Such being the situation, the S content of the steel is defined in the present invention to fall within a range of between 0.20 and 0.49 mass %.

(d) O: Higher than 0.008 Mass % and not Higher than 0.03 Mass %

Oxygen is an element effective for suppressing the elongation of the sulfide in the hot working step such as a rolling step. Therefore, oxygen is an element important for improving the machinability of the steel by suppressing the elongation of the sulfide. However, if the O content is not higher than 0.008 mass %, it is difficult to obtain a sufficient effect of suppressing the elongation of the sulfide. Since the elongated sulfide remains in the steel, it is impossible to obtain a sufficient effect of improving the machinability of the steel. On the other hand, even if the O addition amount exceeds 0.030 mass %, the effect of suppressing the elongation of the sulfide is saturated. It follows that the addition of an excessively large amount of O is disadvantageous in economy. In addition, a casting defect such a blow-hole is generated. Under the circumstances, the O content is defined in the present invention to exceed 0.008 mass % and to be not higher than 0.03 mass %.

(e) Pb: 0.04 to 0.35 Mass %

Lead is an element important for improving the machinability of the steel. However, if the Pb content of the steel is lower than 0.04 mass %, it is impossible to obtain a sufficient effect of improving the machinability of the steel. On the other hand, even if Pb is added in a large amount exceeding 0.35 mass %, the effect of improving the machinability of the steel is saturated. Also, the hot workability of the steel is markedly lowered. Such being the situation, the Pb content of the steel is defined in the present invention to fall within a range of between 0.04 mass % and 0.35 mass %.

(f) Cr: 0.3 to 2.3 Mass %

If the Cr content is lower than 0.3 mass %, it is difficult to obtain a sufficient effect of suppressing the elongation of the sulfide, as described previously in conjunction with the first free-cutting steel of the present invention. Since the elongated sulfide remains in the steel, it is impossible to obtain a sufficient effect of improving the machinability of the steel. On the other hand, even if the Cr addition amount exceeds 2.3 mass %, the effect of suppressing the elongation of the sulfide is saturated. It follows that the addition of an excessively large amount of Cr is disadvantageous in economy. Under the circumstances, the Cr content is defined in the present invention to fall within a range of between 0.3 mass % and 2.3 mass %. Preferably, the Cr content should fall within a range of between 0.3 mass % and 1.4 mass %.

(g) Cr/S Ratio: 2 to 6

The Cr/S ratio is important in the second free cutting steel as in the first free cutting steel. If the Cr/S ratio is smaller than 2, the sulfide elongated by the formation of MnS is rendered prominent so as to deteriorate the machinability of the steel. On the other hand, if the Cr/S ratio exceeds 6, the effect of suppressing the elongation of the sulfide is saturated. Such being the situation, the Cr/S ratio is defined in the present invention to fall within a range of between 2 and 6. Preferably, the Cr/S ratio should fall within a range of between 2 and 4.

The conditions given above are absolutely necessary for the second free cutting steel of the present invention. The other conditions of the second free cutting steel are as follows:

(h) Si: 0.1 Mass % or Less As described previously, Si shortens the tool life.

Such being the situation, where it is desired to further prolong the tool life, it is desirable to define the Si content not to exceed 0.1 mass % as in the first free cutting steel of the present invention.

More desirably, the Si content of the steel should not exceed 0.03 mass %.

(i) P: 0.01 to 0.12 Mass %

If the P content is lower than 0.01 mass %, it is difficult to obtain a sufficient effect of suppressing the finish surface roughness of the steel, as in the first free cutting steel. On the other hand, if the P content exceeds 0.12 mass %, the effect noted above is saturated. Also, the hot workability and the ductility of the steel are markedly lowered. Such being the situation, the P content is defined in the present invention to fall within a range of between 0.01 mass % and 0.12 mass %. Preferably, the P content should fall within a range of between 0.01 mass % and 0.09 mass %.

(j) Al: 0.01 Mass % or Less

Aluminum shortens the tool life as described previously in conjunction with the first free cutting steel. Therefore, where it is desired to further prolong the tool life, it is desirable to define the Al content not to exceed 0.01 mass %. More desirably, the Al content of the steel should not exceed 0.003 mass %.

(k) At Least One of:

Ca: 0.0001 to 0.0005 mass %;
Se: 0.02 to 0.30 mass %;
Te: 0.1 to 0.15 mass %;
Bi: 0.02 to 0.20 mass %;
Sn: 0.003 to 0.020 mass %;
B: 0.004 to 0.010 mass %;
N: 0.005 to 0.015 mass %;
Cu: 0.05 to 0.50 mass %;
Ti: 0.003 to 0.090 mass %;
V: 0.005 to 0.200 mass %;
Zr: 0.005 to 0.090 mass %;
Mg: 0.0005 to 0.0080 mass %.

Any of Ca, Se, Te, Bi, Sn, B, N, Cu, Ti, V, Zr and Mg is used in the case where it is important to improve the machinability of the steel. However, if the addition amount of each of these elements is smaller than the lower limit noted above, the effect of improving the machinability of the steel cannot be obtained. On the other hand, where the addition amount of each of these elements exceeds the upper limit noted above, the effect of improving the machinability of the steel is saturated. Also, the addition of an excessively large amount of each of these elements is disadvantageous in economy. Under the circumstances, in the case of adding these elements, these elements should be added such that Ca falls within a range of between 0.0001 and 0.0005 mass %, Se falls within a range of between 0.02 and 0.30 mass %, Te falls within a range of between 0.1 and 0.15 mass %, Bi falls within a range of between 0.02 and 0.20 mass %, Sn falls within a range of between 0.003 and 0.020 mass %, B falls within a range of between 0.004 and 0.010 mass %, N falls within a range of between 0.005 and 0.015 mass %, Cu falls within a range of between 0.05 and 0.50 mass %, Ti falls within a range of between 0.003 and 0.090 mass %, V falls within a range of between 0.005 and 0.200 mass %, Zr falls within a range of between 0.005 and 0.090 mass %, and Mg falls within a range of between 0.0005 and 0.0080 mass %.

(l) Micro Structure

It is desirable for the micro structure of the second free cutting steel to be a ferrite • pearlite-based structure like the micro structure of the first free cutting steel described previously. Concerning the machinability of the steel, it is advantageous for the prior austenite grain size to be large. However, a satisfactory machinability can be maintained even in the case of fine grains. In view of the mechanical properties of the article, it is desirable for the grains to be fine such that the grain size exceeds the grain size number 7.

3. Third Free Cutting Steel

The third free cutting steel of the present invention is a resulfurized or resulfurized and leaded free cutting steel small according to the third aspect of the present invention, the free cutting steel containing 0.16 to 0.49 mass % of S and 0.002 to 0.010% of O. In the third free cutting steel of the present invention, the sulfide having an aspect ratio not larger than 5 occupies at least 80% of the sulfides having the major axis of at least 10 μm.

The specific free cutting steel, which permits realizing the particular sulfide and which defines the carbon content affecting the machinability of the free cutting steel, contains 0.02 to 0.15 mass % of C, 0.05 to 1.8 mass % of Mn, 0.16 to 0.49 mass % of S, 0.002 to 0.010 mass % of O, 0.3 to 2.3% of Cr, and the balance consisting of Fe and inevitable impurities, the Cr/S ratio falling within a range of between 2 and 6.

It is possible for the third free cutting steel of the present invention to further contain not more than 0.1 mass % of Si, 0.04 to 0.12 mass % of P, and not more than 0.01 mass % of Al.

It is also possible for the third free cutting steel of the present invention to further contain at least one element selected from the group consisting of 0.0001 to 0.0090 mass % of Ca, 0.01 to 0.40 mass % of Pb, 0.02 to 0.30 mass % of Se, 0.03 to 0.15 mass % of Te, 0.02 to 0.20 mass % of Bi, 0.003 to 0.020 mass % of Sn, 0.004 to 0.010 mass % of B, 0.005 to 0.015 mass % of N, 0.05 to 0.50 mass % of Cu, 0.003 to 0.090 mass % of Ti, 0.005 to 0.200 mass % of V, 0.005 to 0.090 mass % of Zr, and 0.0005 to 0.0080 mass % of Mg.

As a result of an extensive research conducted in an effort to achieve the third object described above, the present inventors have found that:

(i) It is possible to allow the free cutting steel to exhibit the machinability including the chip disposability and the surface roughness, which is fully comparable to or higher than that of the conventional steel, by allowing the sulfide having an aspect ratio not larger than 5 to occupy at least 80% of the sulfides having the major axis not smaller than 10 μm and by allowing the sulfide to be large and to be formed like a spindle, even if the oxygen content of the steel is decreased from the level in the conventional steel.

(ii) As described previously, it is possible to obtain a suitable amount of a sulfide containing both Cr and Mn by the addition of suitable amounts of Cr, Mn and S and by optimizing the Cr/S ratio. Since the sulfide containing both Cr and Mn suppresses the elongation in the hot working step, it is possible to obtain the sulfide that is large and formed like a spindle, as described in item (i) above.

(iii) Since it is possible to decrease the oxygen content of the steel from the level in the conventional steel, it is possible to decrease the blow-hole generated in the casting step, compared with the conventional steel. Since the decrease of the blow-hole permits suppressing the generation of the surface flaw in the rolling step derived from the blow-hole, the surface flaw of the rolled can be decreased.

(iv) It is known to the art that the machinability is improved with increase in the S amount. However, there is an upper limit in the S amount because of the problem in terms of the anisotropy in the hot workability or the mechanical properties. On the other hand, if a large and spindle-shaped sulfide is formed as described above, it is possible to elevate the upper limit of the S amount. As a result, the machinability of the free cutting steel including the chip disposability and the surface roughness can be markedly improved.

It is possible for the third free cutting steel described above, which has been obtained on the basis of the ideas given above, to exhibit a machinability fully comparable to or higher than that exhibited by the conventional steel containing substantially the same amounts of sulfur and lead without obstructing the cost reduction and without lowering the hot ductility in spite of the oxygen content lower than that in the conventional steel. Also, since it is possible to lower the oxygen concentration, it is possible to suppress the surface flaw in the rolling step, which is derived from the blow-hole generated in the casting step.

The reasons for defining the composition of the third free cutting steel as described above will now be described.

(a) S: 0.16 to 0.49 Mass %

Sulfur is a sulfide formation element which forms a sulfide effective for improving the machinability of the steel. However, if the S content is lower than 0.16 mass %, the amount of the sulfide formed is excessively small, resulting in failure to obtain a sufficient effect for improving the machinability of the steel. On the other hand, if the S content exceeds 0.49 mass %, the hot workability and the ductility of the steel are markedly lowered. Such being the situation, the S content of steel is defined in the present invention to fall within a range of between 0.16 and 0.49 mass %.

(b) O: 0.002 to 0.010 Mass %

Oxygen is an element effective for suppressing the elongation of the sulfide in the hot working step such as a rolling step. Therefore, oxygen is an element important for improving the machinability of the steel by suppressing the elongation of the sulfide. However, if the O content is not higher than 0.002 mass %, it is difficult to obtain a sufficient effect of suppressing the elongation of the sulfide. Since the elongated sulfide remains in the steel, it is impossible to obtain a sufficient effect of improving the machinability of the steel. On the other hand; O permits generating the blow-hole in the casting step, and the surface flaw is derived from the blow-hole. Therefore, an excessively high O content is harmful. If the O content exceeds 0.010 mass %, a large number of blow-holes are generated and, thus, the surface flaw tends to be increased in the rolling step. In addition, the improvement in the effect of suppressing the elongation of the sulfide is small. Under the circumstances, the O content is defined in the present invention to fall within a range of between 0.002 mass % and 0.010 mass %.

(c) For Sulfide Having an Aspect Ratio of 5 or Less to Occupy at Least 80% of Sulfides Having Major Axis of 10 μm or More:

Concerning the machinability of the steel, it is advantageous for the sulfide to be large and to be formed like a spindle. Therefore, it is necessary for the sulfide having an aspect ratio of 5 or less to occupy at least 80% of the sulfides having the major axis of 10 μm or more.

(d) C: 0.02 to 0.15 Mass %

If the C content is lower than 0.02 mass %, it is impossible to obtain a sufficient strength of the steel, as in the first free cutting steel. On the other hand, if the C content exceeds 0.15 mass %, the strength of the steel is rendered excessively high so as to deteriorate the machinability of the steel. Such being the situation, the C content is defined in the present invention to fall within a range of between 0.02 mass % and 0.15 mass %. Preferably, the C content should fall within a range of between 0.02 mass % and 0.10 mass %.

(e) Mn: 0.05 to 1.8 Mass %

If the Mn content is lower than 0.05 mass %, the amount of the sulfide formed is excessively small, resulting in failure to obtain a sufficient machinability, as in the first free cutting steel described previously. On the other hand, if the Mn content exceeds 1.8 mass %, the formed sulfide is much elongated, with the result that the machinability of the steel is lowered. Such being the situation, the Mn content is defined in the present invention to fall within a range of between 0.05 and 1.8 mass %. Preferably, the Mn content should be not lower than 0.22 mass % and lower than 0.60 mass %.

(f) Cr: 0.3 to 2.3 Mass %

If the Cr content is lower than 0.3 mass %, it is difficult to obtain a sufficient effect of suppressing the elongation of the sulfide, as in the first free cutting steel described previously. Since the elongated sulfide remains in the steel, it is impossible to obtain a sufficient effect of improving the machinability of the steel. On the other hand, even if the Cr addition amount exceeds 2.3 mass %, the effect of suppressing the elongation of the sulfide is saturated. It follows that the addition of an excessively large amount of Cr is disadvantageous in economy. Under the circumstances, the Cr content is defined in the present invention to fall within a range of between 0.3 mass % and 2.3 mass %. Preferably, the Cr content should fall within a range of between 0.3 mass % and 1.5 mass %.

(g) Cr/S Ratio: 2 to 6

The Cr/S ratio is important in the third free cutting steel as in the first and second free cutting steels. If the Cr/S ratio is smaller than 2, the sulfide elongated by the formation of MnS is rendered prominent so as to deteriorate the machinability of the steel. On the other hand, if the Cr/S ratio exceeds 6, the effect of suppressing the elongation of the sulfide is saturated. Such being the situation, the Cr/S ratio is defined in the present invention to fall within a range of between 2 and 6. Preferably, the Cr/S ratio should fall within a range of between 2 and 4.

The other conditions of the third free cutting steel are as follows:

(h) Si: 0.1 Mass % or Less

As described above, Si shortens the tool life.

Therefore, where it is desired to further prolong the tool life, it is desirable to define the Si content not to exceed 0.1 mass %. More desirably, the Si content of the steel should not exceed 0.03 mass %.

(i) P: 0.04 to 0.12 Mass %

If the P content is lower than 0.04 mass %, it is difficult to produce effectively the effect of suppressing the formation of the built-up edge in the cutting process step, resulting in failure to obtain a sufficient effect of lowering the finish surface roughness. On the other hand, if the P content exceeds 0.12 mass %, the effect noted above is saturated. Also, the hot workability and the ductility of the steel are markedly lowered. Such being the situation, the P content is defined in the present invention to fall within a range of between 0.04 mass % and 0.12 mass %.

(j) Al: 0.01 Mass % or Less

Since Al deteriorates the tool life as described previously it is desirable to define the Al content not to exceed 0.01 mass %, where it is desired to further prolong the tool life. More desirably, the Al content of the steel should not exceed 0.003 mass %.

(k) At Least One of:

Ca: 0.0001 to 0.0090 mass %;
Pb: 0.01 to 0.40 mass %;
Se: 0.02 to 0.30 mass %;
Te: 0.03 to 0.15 mass %;
Bi: 0.02 to 0.20 mass %;
Sn: 0.003 to 0.020 mass %;
B: 0.004 to 0.010 mass %;
N: 0.005 to 0.015 mass %;
Cu: 0.05 to 0.50 mass %;
Ti: 0.003 to 0.090 mass %;
V: 0.005 to 0.200 mass %;
Zr: 0.005 to 0.090 mass %;
Mg: 0.0005 to 0.0080 mass %.

Any of Ca, Pb, Se, Te, Bi, Sn, B, N, Cu, Ti, V, Zr and Mg is used in the case where it is important to improve the machinability of the steel. However, if the addition amount of each of these elements is smaller than the lower limit noted above, the effect of improving the machinability of the steel cannot be obtained. On the other hand, where the addition amount of each of these elements exceeds the upper limit noted above, the effect of improving the machinability of the steel is saturated. Also, the addition of an excessively large amount of each of these elements is disadvantageous in economy. Under the circumstances, in the case of adding these elements, these elements should be added such that Ca falls within a range of between 0.0001 and 0.0090 mass %, Pb falls within a range of between 0.01 and 0.40 mass %, Se falls within a range of between 0.02 and 0.30 mass %, Te falls within a range of between 0.03 and 0.15 mass %, Bi falls within a range of between 0.02 and 0.20 mass %, Sn falls within a range of between 0.003 and 0.020 mass %, B falls within a range of between 0.004 and 0.010 mass %, N falls within a range of between 0.005 and 0.015 mass %, Cu falls within a range of between 0.05 and 0.50 mass %, Ti falls within a range of between 0.003 and 0.090 mass %, V falls within a range of between 0.005 and 0.200 mass %, Zr falls within a range of between 0.005 and 0.090 mass %, and Mg falls within a range of between 0.0005 and 0.0080 mass %.

(l) Micro Structure

It is desirable for the micro structure of the third free cutting steel to be a ferrite • pearlite-based structure like the first and second free cutting steels. Concerning the machinability of the steel, it is advantageous for the prior austenite grain size to be large. However, a satisfactory machinability can be maintained even in the case of fine grains. In view of the mechanical properties of the article, it is desirable for the grains to be fine such that the grain size exceeds the grain size number 7.

Incidentally, the manufacturing method of each of the first to third free cutting steels of the present invention is not particularly limited. It is possible to carry out the casting and the hot rolling under the ordinary conditions. The subsequent heat treatment is not particularly limited, either. For example, it is possible to employ the ordinary normalizing.

EXAMPLES

Some Examples of the present invention will now be described.

First Example

The first Example is directed to Examples of the first free cutting steel.

Prepared were steel samples Nos. 1 to 6 each having a chemical composition falling within the range of the first free cutting steel of the present invention (hereinafter referred to as Examples of the present invention), as shown in Table 1, steel samples Nos. 7 to 11 each having a chemical composition failing to fall within the range of the first free cutting steel of the present invention (hereinafter referred to as Comparative Examples), and a steel sample No. 12 used as a reference Example and directed to a low carbon resulfurized and leaded free cutting steel. Each of these steel samples was smelted and then casted into an ingot having a cross sectional area of 400 mm×300 mm, followed by subjecting the ingot to a hot rolling so as to obtain an 80 mm diameter steel rod. Further, the steel rod thus obtained was subjected to a normalizing treatment such that the steel rod was heated at 925° C. for one hour, followed by cooling the heated steel rod to room temperature by means of the air cooling.

The form of the sulfide of each steel rod thus manufactured was measured. Also, a test for the machinability was applied to the steel rod thus manufactured.

For measuring the form of the sulfide, the major axis L (length in the rolling direction) and the minor axis d (thickness or length in a direction perpendicular to the rolling direction) were measured by an image analyzing apparatus in respect of all the sulfides present in a region of 5.5 mm×11 mm in the central portion of steel rod. Also, obtained was a ratio of the sulfides having the major axis not smaller than 10 μm and a ratio of the sulfides having an aspect ratio L/d not larger than 5 to all the sulfides having the major axis not smaller than 10 μm. Further, a machinability test was conducted under the conditions shown in Table 2.

TABLE 1

| No. | Classification | Chemical Composition (mass %) | | | | | | | | | | | |
|---|---|---|---|---|---|---|---|---|---|---|---|---|---|
| | | C | Si | Mn | P | S | Cr | Al | N | O | Bi | Pb | Cr/S |
| 1 | Present Invention | 0.06 | tr | 0.51 | 0.077 | 0.402 | 1.23 | tr | 0.006 | 0.004 | tr | tr | 3.06 |
| 2 | Present Invention | 0.06 | tr | 0.22 | 0.075 | 0.304 | 0.75 | 0.001 | 0.007 | 0.003 | tr | tr | 2.47 |
| 3 | Present Invention | 0.02 | 0.01 | 0.51 | 0.077 | 0.403 | 1.35 | tr | 0.01 | 0.006 | tr | tr | 3.35 |
| 4 | Present Invention | 0.13 | tr | 0.52 | 0.014 | 0.404 | 1.12 | tr | 0.012 | 0.005 | tr | tr | 2.77 |
| 5 | Present Invention | 0.07 | 0.08 | 1.32 | 0.078 | 0.455 | 2.09 | tr | 0.02 | 0.02 | tr | tr | 4.59 |
| 6 | Present Invention | 0.08 | tr | 1.53 | 0.074 | 0.301 | 0.63 | 0.008 | 0.005 | 0.004 | 0.05 | 0.02 | 2.09 |
| 7 | Comparative Example | 0.06 | 0.01 | 2.52 | 0.077 | 0.403 | 1.12 | tr | 0.008 | 0.006 | tr | tr | 2.78 |
| 8 | Comparative Example | 0.08 | tr | 0.53 | 0.074 | 0.177 | 0.88 | tr | 0.007 | 0.005 | tr | tr | 4.97 |
| 9 | Comparative Example | 0.07 | tr | 0.54 | 0.078 | 0.431 | 0.23 | tr | 0.006 | 0.005 | tr | tr | 0.53 |
| 10 | Comparative Example | 0.06 | tr | 1.49 | 0.077 | 0.399 | 1.51 | 0.001 | 0.01 | 0.001 | tr | tr | 3.78 |
| 11 | Comparative Example | 0.06 | tr | 0.52 | 0.079 | 0.402 | 0.52 | 0.001 | 0.012 | 0.005 | tr | tr | 1.29 |
| 12 | Reference Example | 0.07 | tr | 1.22 | 0.071 | 0.319 | 0.05 | tr | 0.01 | 0.015 | tr | 0.21 | 0.16 |

TABLE 2

| Item | Tool Material | Cutting Conditions | | | | | Evaluation Method |
|---|---|---|---|---|---|---|---|
| | | Feeding Rate (mm/rev) | Cutitng Depth (mm) | Cutting Rate (m/min) | Cutting Time (min) | Lubricant | |
| Turning | P20 | 0.20 | 2.0 | 150 | | None | Life: Cutting Time until Front Flank Wear Amount VB is increased to reach 0.2 mm |
| | | 0.10 | | 30, 50 | | | Evaluation in the Shape of Chips (sum of 15 cutting donditions) |
| | | 0.20 | 2.0 | 100, 150 | 1 | None | Single Chip had a Length shorter than 30 mm: 1 point |
| | | 0.30 | | 200 | | | Single Chip had a Length not shorter than 30 mm: 3 point |
| | | 0.20 | 2.0 | 150 | 1 | None | Maximum Surface Roughness Rmax |
| | SKH4 | 0.20 | 2.0 | 100 | | None | Life: Until Incapability of Cutting |
| Drilling | SKH51 (ϕ10) | 0.35 | | 20~80 | | Use of Water-Soluble Cutting Oil | Life: Cutting Rate that makes cutting impossible at 1000 mm in total length of drilling |

Figure 2:
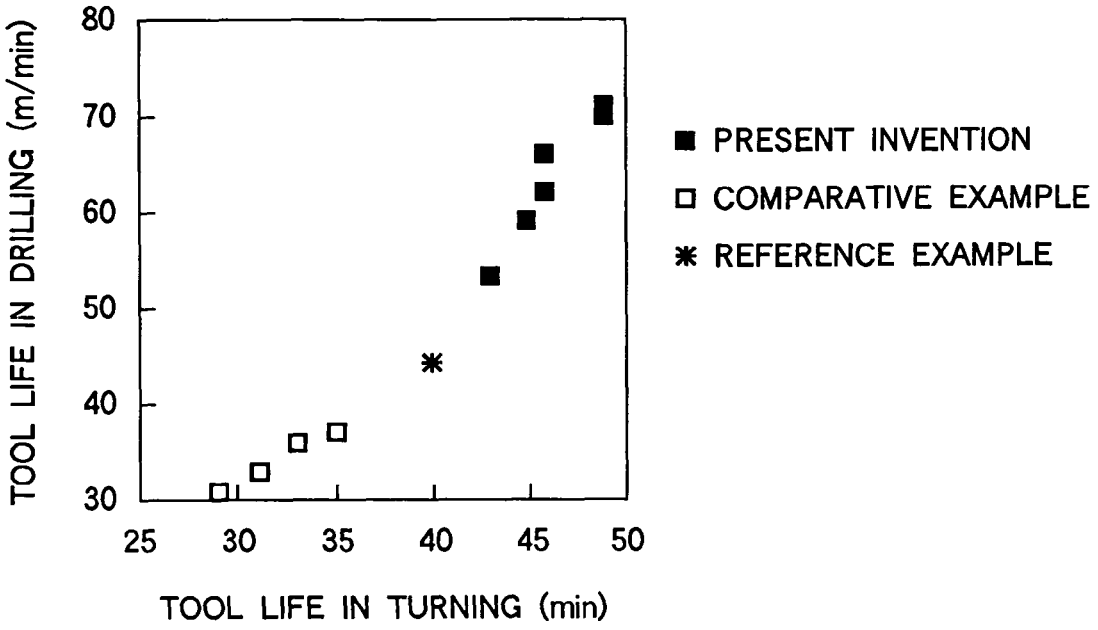
FIG. 2 is a graph showing the relationship in tool life between turning and drilling.

Table 3 shows the results. Also, FIG. 2 is a graph showing the relationship between the life of the turning tool (SKH4), which is taken up as a typical characteristic value, and the life of the drilling tool.

As apparent from Table 3, it was confirmed that any of samples Nos. 1 to 6 of the present invention had been satisfactory in various characteristics, compared with the low carbon resulfurized and leaded free cutting steel for sample No. 12 (Reference Example).

On the other hand, the Mn content exceeded the upper limit specified in the present invention in sample No. 7 for the Comparative Example. The Cr content was lower than the lower limit specified in the present invention in sample No. 9 for the Comparative Example. The O content was insufficient in sample No. 10 for the Comparative Example. Further, the Cr/S ratio was lower than the lower limit specified in the present invention in sample No. 11 for the Comparative Example. As a result, the aspect ratio of the sulfide was rendered large in each of these steel samples of the Comparative Example and, thus, these steel samples were rendered inferior to the steel samples of the present invention in the machinability. On the other hand, the S content of the steel sample No. 8 for the Comparative Example was lower than the lower limit specified in the present invention. Therefore, the steel sample No. 8 noted above was insufficient in the total amount of the sulfide effective for improving the machinability of the steel, with the result that the steel sample No. 8 was inferior in the machinability of the steel to the steel samples of the present invention.

TABLE 3

| No. | Classification | Form of Sulfide: Ratio of Sulfides having Major Axis not smaller than 10 μm (%) | Form of Sulfide: Ratio of Sulfides having Aspect Ratio ≦ 5 (%) | Tool Life: Life of Turning P20 (min) | Tool Life: Life of Turning SKH4 (min) | Tool Life: Life of Drill (m/min) | Chip: Disposability Evaluation of Chip (point) | Surface Roughness Rmax (μm) | Micro Structure | Prior γ Grain Size |
|---|---|---|---|---|---|---|---|---|---|---|
| 1 | Present Invention | 98 | 88 | 48 | 46 | 66 | 15 | 14 | Ferrite-Pearlite | 8 |
| 2 | Present Invention | 96 | 86 | 44 | 43 | 53 | 15 | 15 | Ferrite-Pearlite | 8 |
| 3 | Present Invention | 95 | 85 | 50 | 49 | 71 | 15 | 14 | Ferrite-Pearlite | 7 |
| 4 | Present Invention | 97 | 83 | 46 | 45 | 59 | 15 | 22 | Ferrite-Pearlite | 7 |
| 5 | Present Invention | 98 | 84 | 47 | 46 | 62 | 15 | 16 | Ferrite-Pearlite | 8 |
| 6 | Present Invention | 96 | 82 | 50 | 49 | 70 | 15 | 15 | Ferrite-Pearlite | 8 |
| 7 | Comparative Example | 74 | 41 | 23 | 33 | 36 | 33 | 35 | Ferrite-Pearlite | 7 |
| 8 | Comparative Example | 65 | 38 | 24 | 35 | 37 | 37 | 37 | Ferrite-Pearlite | 7 |
| 9 | Comparative Example | 63 | 46 | 24 | 31 | 33 | 36 | 36 | Ferrite-Pearlite | 8 |
| 10 | Comparative Example | 55 | 41 | 22 | 30 | 32 | 32 | 35 | Ferrite-Pearlite | 8 |
| 11 | Comparative Example | 61 | 39 | 21 | 29 | 31 | 31 | 36 | Ferrite-Pearlite | 8 |
| 12 | Reference Example | 73 | 42 | 41 | 40 | 44 | 21 | 17 | Ferrite-Pearlite | 8 |

Second Example

The second Example is directed to the second free cutting steel of the present invention.

Cast under the conditions equal to those for the first Example were steel samples Nos. 21 to 26 for the present invention each having the chemical composition falling within the range specified for the second free cutting steel of the present invention as shown in Table 4, steel samples Nos. 27 to 31 for the Comparative Example each having a chemical composition failing to fall within the range specified for the second free cutting steel of the present invention, and a steel sample No. 32 for the reference Example directed to a low carbon resulfurized and leaded free cutting steel. The cast steel samples were subjected to a hot rolling and, then, to a normalizing under the conditions equal to those for the first Example.

The form of the sulfide was measured and a machinability test was applied as in the first Example in respect of each of the steel rod samples thus manufactured and having the compositions as shown in Table 4.

TABLE 4

| No. | Classification | Chemical Composition (mass %): C | Si | Mn | P | S | Cr | Al | N | O | Zr | Pb | Cr/S |
|---|---|---|---|---|---|---|---|---|---|---|---|---|---|
| 21 | Present Invention | 0.06 | tr | 0.53 | 0.075 | 0.401 | 1.21 | 0.001 | 0.007 | 0.008 | tr | 0.25 | 3.02 |
| 22 | Present Invention | 0.05 | tr | 0.21 | 0.074 | 0.303 | 0.74 | 0.001 | 0.007 | 0.009 | tr | 0.23 | 2.44 |
| 23 | Present Invention | 0.02 | 0.08 | 0.51 | 0.077 | 0.401 | 1.39 | tr | 0.011 | 0.011 | tr | 0.24 | 3.32 |
| 24 | Present Invention | 0.13 | 0.01 | 0.52 | 0.013 | 0.402 | 1.11 | tr | 0.011 | 0.015 | tr | 0.22 | 2.76 |
| 25 | Present Invention | 0.06 | tr | 1.35 | 0.076 | 0.458 | 2.09 | tr | 0.014 | 0.024 | tr | 0.25 | 4.56 |
| 26 | Present Invention | 0.09 | tr | 1.51 | 0.073 | 0.303 | 0.64 | 0.008 | 0.006 | 0.015 | 0.05 | 0.24 | 2.11 |
| 27 | Comparative Example | 0.06 | 0.01 | 2.55 | 0.076 | 0.405 | 1.15 | tr | 0.009 | 0.01 | tr | 0.25 | 2.84 |
| 28 | Comparative Example | 0.07 | 0.01 | 0.53 | 0.072 | 0.175 | 0.84 | tr | 0.008 | 0.009 | tr | 0.23 | 4.80 |
| 29 | Comparative Example | 0.08 | tr | 0.52 | 0.075 | 0.434 | 0.23 | 0.001 | 0.011 | 0.01 | tr | 0.24 | 0.53 |
| 30 | Comparative Example | 0.07 | tr | 0.52 | 0.077 | 0.403 | 0.53 | 0.001 | 0.014 | 0.015 | tr | 0.24 | 1.32 |

TABLE 4-continued

| No. | Classification | Chemical Composition (mass %) | | | | | | | | | | | |
|---|---|---|---|---|---|---|---|---|---|---|---|---|---|
| | | C | Si | Mn | P | S | Cr | Al | N | O | Zr | Pb | Cr/S |
| 31 | Comparative Example | 0.12 | 0.07 | 1.13 | 0.074 | 0.345 | 1.51 | tr | 0.01 | 0.002 | 0.08 | 0.09 | 4.38 |
| 32 | Reference Example | 0.06 | tr | 1.23 | 0.072 | 0.315 | 0.04 | tr | 0.01 | 0.015 | tr | 0.22 | 0.13 |

Table 5 shows the results of the test. As apparent from Table 5, it was confirmed that any of the steel samples Nos. 21 to 26 for the present invention had satisfactory characteristics, compared with the steel sample No. 32 for the reference Example directed to a low carbon resulfurized and leaded free cutting steel.

On the other hand, the Mn content of the steel sample No. 27 for the Comparative Example exceeded the upper limit specified in the present invention. The Cr content of the steel sample No. 29 for the Comparative Example was lower than the lower limit specified in the present invention. The Cr/S ratio in the steel sample No. 30 for the Comparative Example was lower than the lower limit specified in the present invention. Further, the O content of the steel sample No. 31 for the Comparative Example was insufficient. As a result, the aspect ratio of the sulfide was rendered large in each of these steel samples for the Comparative Example and, thus, the machinability of each of these steel samples for the Comparative Example was found to be inferior to that of any of the steel samples for the present invention. Further, the S content of the steel sample No. 28 for the Comparative Example was lower than the lower limit specified in the present invention. As a result, the total amount of the sulfides effective for improving the machinability of the steel was insufficient and, thus, the steel sample No. 28 was inferior in the machinability to any of the steel samples for the present invention.

TABLE 5

| No. | Classification | Aspect Ratio of Sulfide | | Tool Life | | | Chip Disposability | Surface |
|---|---|---|---|---|---|---|---|---|
| | | Average Value (–) | Maximum Value (–) | Life of Turning P20 (min) | Life of Turning SKH4 (min) | Life of Drill (m/min) | Evaluation of Chip (point) | Roughness Rmax (μm) |
| 21 | Present Invention | 3.5 | 15 | 47 | 45 | 66 | 15 | 14 |
| 22 | Present Invention | 3.6 | 16 | 45 | 44 | 62 | 15 | 15 |
| 23 | Present Invention | 3.7 | 15 | 49 | 48 | 71 | 15 | 15 |
| 24 | Present Invention | 3.5 | 16 | 46 | 45 | 59 | 15 | 21 |
| 25 | Present Invention | 2.9 | 11 | 60 | 55 | 80 | 15 | 12 |
| 26 | Present Invention | 3.7 | 16 | 49 | 49 | 70 | 15 | 15 |
| 27 | Comparative Example | 6.3 | 43 | 22 | 31 | 35 | 35 | 36 |
| 28 | Comparative Example | 3.6 | 16 | 23 | 34 | 36 | 36 | 38 |
| 29 | Comparative Example | 6.7 | 46 | 24 | 33 | 32 | 36 | 36 |
| 30 | Comparative Example | 9.7 | 71 | 22 | 30 | 31 | 32 | 37 |
| 31 | Comparative Example | 6.5 | 44 | 21 | 29 | 31 | 32 | 36 |
| 32 | Reference Example | 6.2 | 41 | 41 | 40 | 44 | 21 | 17 |

Third Example

The third Example is directed to the third free cutting steel of the present invention.

Cast under the conditions equal to those for the first Example were steel samples Nos. 41 to 46 for the present invention each having the chemical composition falling within the range specified for the third free cutting steel of the present invention as shown in Table 6, steel samples Nos. 47 to 51 for the Comparative Example each having a chemical composition failing to fall within the range specified for the third free cutting steel of the present invention, and a steel sample No. 52 for the reference Example directed to JIS SUM23L. The cast steel samples were subjected to a hot rolling and, then, to a normalizing under the conditions equal to those for the first example.

The form of the sulfide was measured and a machinability test was applied as in the first Example in respect of each of the steel rod samples thus manufactured and having the compositions as shown in Table 6.

TABLE 6

| No. | Classification | Chemical Composition (mass %) | | | | | | | | | | |
|---|---|---|---|---|---|---|---|---|---|---|---|---|
| | | C | Si | Mn | P | S | Cr | Al | O | N | Pb | Cr/S |
| 41 | Present Invention | 0.05 | 0.01 | 0.52 | 0.076 | 0.403 | 1.22 | tr | 0.004 | 0.0084 | tr | 3.03 |
| 42 | Present Invention | 0.13 | tr | 0.23 | 0.014 | 0.404 | 1.13 | 0.008 | 0.005 | 0.0075 | tr | 2.80 |
| 43 | Present Invention | 0.08 | 0.01 | 1.34 | 0.078 | 0.457 | 2.08 | tr | 0.01 | 0.0078 | tr | 4.55 |
| 44 | Present Invention | 0.02 | 0.08 | 1.53 | 0.074 | 0.301 | 0.63 | 0.001 | 0.004 | 0.0121 | 0.06 | 2.09 |
| 45 | Present Invention | 0.06 | tr | 0.51 | 0.072 | 0.318 | 0.79 | tr | 0.008 | 0.0082 | tr | 2.48 |
| 46 | Present Invention | 0.06 | tr | 0.52 | 0.071 | 0.315 | 0.78 | tr | 0.009 | 0.0080 | tr | 2.48 |
| 47 | Comparative Example | 0.08 | tr | 2.54 | 0.077 | 0.402 | 1.13 | 0.001 | 0.006 | 0.0071 | tr | 2.81 |
| 48 | Comparative Example | 0.06 | tr | 0.54 | 0.073 | 0.105 | 0.85 | tr | 0.007 | 0.0065 | tr | 8.10 |
| 49 | Comparative Example | 0.07 | 0.01 | 0.54 | 0.076 | 0.433 | 0.22 | tr | 0.005 | 0.0082 | tr | 0.51 |
| 50 | Comparative Example | 0.06 | tr | 1.49 | 0.077 | 0.399 | 1.51 | 0.001 | 9E−04 | 0.0091 | tr | 3.78 |
| 51 | Comparative Example | 0.07 | tr | 0.51 | 0.079 | 0.402 | 0.51 | 0.001 | 0.007 | 0.0061 | tr | 1.27 |
| 52 | Reference Example | 0.06 | tr | 1.22 | 0.071 | 0.319 | 0.05 | tr | 0.015 | 0.0082 | 0.21 | 0.16 |

Table 7 shows the results of the test. As apparent from Table 7, each of steel samples Nos. 41 to 44 included in the steel samples of the present invention was found to have satisfactory characteristics, compared with the steel sample No. 52 for the reference Example directed to JIS SUM23L. Also, the steel sample No. 45 for the present invention, which is equal in the S content to and a half in the 0 content of the steel sample No. 52 for the reference Example directed to JIS SUM23L, was found to be substantially equal in the machinability to the steel sample No. 52 (JIS SUM23L). In addition, a surface flaw was scarcely found in the steel sample No. 45 for the present invention. Further, the steel sample No. 46 for the present invention, which had a S content equal to that of the steel sample No. 52 for the reference Example directed to JIS SUM23L and had an O content lower than that of the steel sample NO. 52 noted above and higher than that of the steel sample NO. 45 for the present invention, was found to be satisfactory in the machinability, compared with the steel sample No. 52.

On the other hand, the Mn content of the steel sample No. 47 for the Comparative Example exceeded the upper limited specified in the present invention. The Cr content of the steel sample No. 49 for the Comparative Example was lower than the lower limit specified in the present invention. Further, the Cr/S ratio of the steel sample 51 for the Comparative Example was lower than the lower limit specified in the present invention. As a result, the sulfide in each of these steel samples for the Comparative Examples had a large aspect ratio and, thus, each of these steel samples was found to be inferior in machinability to any of the steel samples of the present invention. Further, the S content of the steel sample No. 48 for the Comparative Example was lower than the lower limit specified in the present invention. Therefore, the steel sample No. 48 for the Comparative Example was insufficient in the total amount of the sulfides effective for improving the machinability of the steel and, thus, was also inferior in the machinability to any of the steel samples of the present invention. Still further, the O content of the steel sample No. 50 for the Comparative Example was lower than the lower limit specified in the present invention and, thus, the steel sample No. 50 was inferior in the machinability to any of the steel samples of the present invention.

TABLE 7

| No. | Classification | Ratio of Sulfide having Major Axis of 10 μm or more and also having Aspect Ratio of ≦ 5 (−) | Tool Life | | | Chip Disposability | Surface | Surface Flaw |
|---|---|---|---|---|---|---|---|---|
| | | | Life of Turning P20 (min) | Life of Turning SKH4 (min) | Life of Drill (m/min) | Evaluation of Chip (point) | Roughness Rmax (μm) | Total Length (cm) |
| 41 | Present Invention | 86 | 47 | 46 | 66 | 15 | 14 | 0 |
| 42 | Present Invention | 85 | 46 | 44 | 59 | 15 | 22 | 0 |
| 43 | Present Invention | 85 | 47 | 46 | 63 | 15 | 16 | 5 |
| 44 | Present Invention | 87 | 50 | 49 | 70 | 15 | 15 | 0 |
| 45 | Present Invention | 86 | 41 | 41 | 45 | 19 | 16 | 2.5 |
| 46 | Present Invention | 87 | 49 | 49 | 71 | 15 | 15 | 5.5 |

TABLE 7-continued

| No. | Classification | Ratio of Sulfide having Major Axis of 10 μm or more and also having Aspect Ratio of ≦ 5 (–) | Tool Life: Life of Turning P20 (min) | Tool Life: Life of Turning SKH4 (min) | Tool Life: Life of Drill (m/min) | Chip Disposability: Evaluation of Chip (point) | Surface Roughness Rmax (μm) | Surface Flaw Total Length (cm) |
|---|---|---|---|---|---|---|---|---|
| 47 | Comparative Example | 53 | 22 | 32 | 36 | 34 | 36 | 0 |
| 48 | Comparative Example | 63 | 23 | 35 | 36 | 36 | 38 | 7.5 |
| 49 | Comparative Example | 46 | 24 | 32 | 32 | 36 | 36 | 0 |
| 50 | Comparative Example | 45 | 22 | 30 | 32 | 32 | 35 | 0 |
| 51 | Comparative Example | 65 | 21 | 29 | 31 | 31 | 36 | 0 |
| 52 | Reference Example | 63 | 41 | 40 | 44 | 21 | 17 | 42.5 |

What is claimed is:

1. A low carbon free cutting steel containing 0.02 to 0.15 mass % of C, 0.05 to 1.8 mass % of Mn, 0.20 to 0.49 mass % of S, more than 0.01 mass % and not more than 0.03 mass % of O, 0.3 to 2.3 mass % of Cr, not more than 0.1 mass % of Si, 0.01 to 0.12 mass % of P, not more than 0.01 mass % of Al, less than 0.03 mass % of Pb and the balance consisting of Fe and inevitable impurities, wherein a ratio of Cr/S falls within a range of between 2 and 6, said steel containing sulfides such that sulfides having a major axis of at least 10 μm occupy at least 90% of all the sulfides, and sulfides having an aspect ratio not larger than 5 occupy at least 80% of the sulfides having a major axis of at least 10 μm.

2. A low carbon free cutting steel containing 0.02 to 0.15 mass % of C, 0.05 to 1.8 mass % of Mn, 0.20 to 0.49 mass % of S, more than 0.01 mass % and not more than 0.03 mass % of O, 0.3 to 2.3 mass % of Cr, not more than 0.1 mass % of Si, 0.01 to 0.12 mass % of P, not more than 0.01 mass % of Al, and at least one element selected from the group consisting of 0.0001 to 0.0005 mass % of Ca, 0.01 to 0.03 mass % of Pb, 0.02 to 0.30 mass % of Se, 0.1 to 0.15 mass % of Te, 0.02 to 0.20 mass % of Bi, 0.003 to 0.020 mass % of Sn, 0.004 to 0.010 mass % of B, 0.005 to 0.015 mass % of N, 0.05 to 0.50 mass % of Cu, 0.003 to 0.090 mass % of Ti, 0.005 to 0.200 mass % of V, 0.005 to 0.090 mass % of Zr, and 0.0005 to 0.0080 mass % of Mg, along with the balance consisting of Fe and inevitable impurities, wherein a ratio of Cr/S falls within a range of between 2 and 6, said steel contains sulfides such that sulfides having a major axis of at least 10 μm occupy at least 90% of all the sulfides, and sulfides having an aspect ratio not larger than 5 occupy at least 80% of the sulfides having a major axis of at least 10 μm.

3. The low carbon free cutting steel according to claim 1, wherein the free cutting steel has a ferrite-pearlite structure, and the prior austenite grain size exceeds the grain size number 7 measured by the austenite grain size measuring method specified in JIS G 0551.

4. The low carbon free cutting steel according to claim 2, wherein the free cutting steel has a ferrite-pearlite structure, and the prior austenite grain size exceeds the grain size number 7 measured by the austenite grain size measuring method specified in JIS G 0551.

* * * * *